US005887781A

United States Patent [19]

Marx et al.

[11] Patent Number: 5,887,781

[45] Date of Patent: Mar. 30, 1999

[54] HEXAGONAL PAPERBOARD CARTON WITH THERMOFORMED REINFORCING LID

[75] Inventors: Ronald Marx, Appleton; James Cheshire, Neenah; Mark Littlejohn, Appleton, all of Wis.; Norman Turner, St. Charles, Ill.; James Capo, Middletown, Ohio

[73] Assignee: Fort James Corporation, Deerfield, Ill.

[21] Appl. No.: 926,485

[22] Filed: Sep. 10, 1997

Related U.S. Application Data

[63] Continuation of Ser. No. 523,365, Sep. 5, 1995, abandoned.

[51] Int. Cl.[6] ..... B65D 5/36; B65D 5/49

[52] U.S. Cl. ..... 229/120.32; 229/110; 229/120.07; 229/125.05; 229/125.17

[58] Field of Search ..... 229/107, 110, 229/120.07, 120.32, 120.37, 125.05, 125.13, 902, 906, 109, 125.17, 125.32; 220/256, 521, 522

[56] References Cited

U.S. PATENT DOCUMENTS

| | | | |
|---|---|---|---|
| 1,903,647 | 4/1933 | Usher | 229/125.17 |
| 2,179,095 | 11/1939 | Kelsey | 220/522 |
| 2,623,685 | 12/1952 | Hill | 229/125.17 |
| 2,739,751 | 3/1956 | Bailey | 220/522 |
| 2,766,796 | 10/1956 | Tupper | 220/521 |
| 2,917,222 | 12/1959 | Frankenstein | 229/110 X |
| 3,047,199 | 7/1962 | McBain | 229/125.05 X |
| 3,101,167 | 8/1963 | Styler . | |
| 3,144,192 | 8/1964 | Seline, Jr. | 229/183 |
| 3,506,459 | 4/1970 | Parlour | 220/522 |
| 3,537,610 | 11/1970 | Bilon | 220/522 |
| 3,809,310 | 5/1974 | VanderLugt, Jr. . | |
| 3,924,736 | 12/1975 | Bell et al. | 229/110 X |
| 4,042,169 | 8/1977 | Burgdorf | 229/125.17 |
| 4,091,953 | 5/1978 | Daenen | 220/521 X |
| 4,109,822 | 8/1978 | Egli | 229/125.05 X |
| 4,380,447 | 4/1983 | Vanderlugt, Jr. | 229/125.17 |
| 4,495,209 | 1/1985 | Whiteside | 229/125.17 |
| 4,503,572 | 3/1985 | Dawson | 220/521 X |
| 4,557,414 | 12/1985 | Ford et al. | 229/125.05 X |
| 4,579,246 | 4/1986 | Swearingen et al. | 229/125.05 X |
| 4,736,885 | 4/1988 | Negus, Sr. | 229/110 |
| 4,892,247 | 1/1990 | Dirksing et al. | 229/125.32 |
| 5,045,333 | 9/1991 | Petrofsky et al. | 220/521 X |
| 5,209,391 | 5/1993 | Krautsack . | |
| 5,318,787 | 6/1994 | Brauner et al. . | |

FOREIGN PATENT DOCUMENTS

| | | | |
|---|---|---|---|
| 2026427 | 2/1980 | United Kingdom | 229/125.17 |

*Primary Examiner*—Gary E. Elkins

*Attorney, Agent, or Firm*—Sixbey, Friedman, Leedom & Ferguson, PC; Charles M. Leedom, Jr.; Donald R. Studebaker

[57] ABSTRACT

A collapsible carton for containing articles such as prepared food and the like, including a plurality of side panels hingedly connected to one another by substantially parallel fold lines is disclosed. A bottom panel formed of a plurality of cooperating end panels hingedly connected to respective side panels and a closure for closing a top opening of the hexagonal carton with the closure being telescopically received within the top opening of the hexagonal carton and frictionally engaged with an inside surface of at least one of the side panels. Additionally, the closure may include a supplemental compartment formed therein for containing articles of a type different than that placed in the main body of the carton. In this case, a supplemental closure is provided which cooperates with the first closure for closing off the supplemental compartment. Preferably, the bottom panel is formed of a plurality of cooperating end panels including a main end panel which covers an entire inner surface of the bottom of the carton and which is hingedly connected to one of the side panels, a secondary end panel hingedly connected to a side panel diametrically opposed to the first mentioned side panel and adhered to an outer surface of the main panel, as well as two pairs of supporting end panels hingedly connected to the remaining side panels with each of said pairs of supporting end panels being adhered to one another and underlie at least a portion of the main end panel when the carton is in an erect condition.

15 Claims, 6 Drawing Sheets

FIG. 4
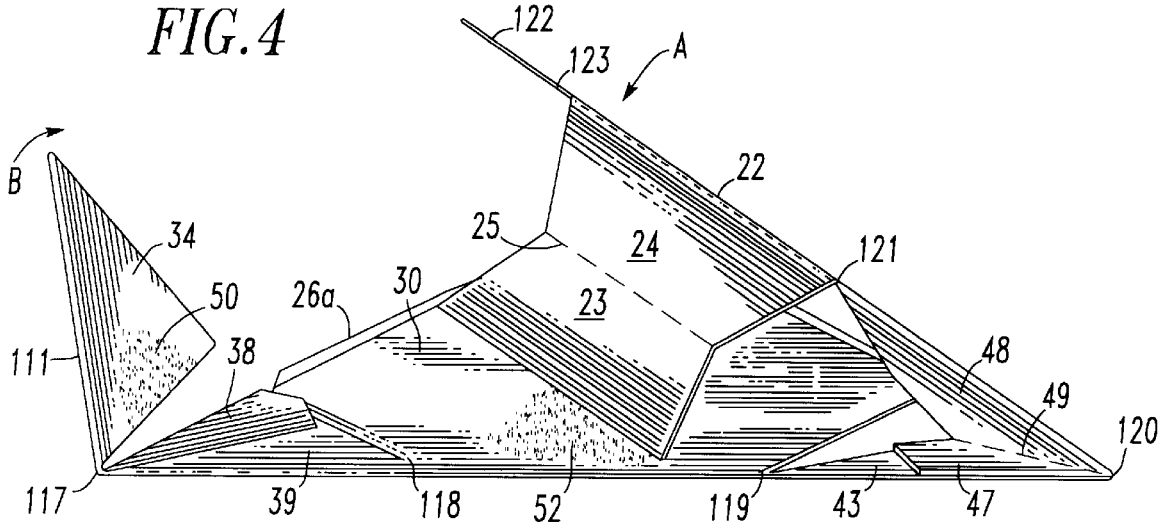
FIG. 5
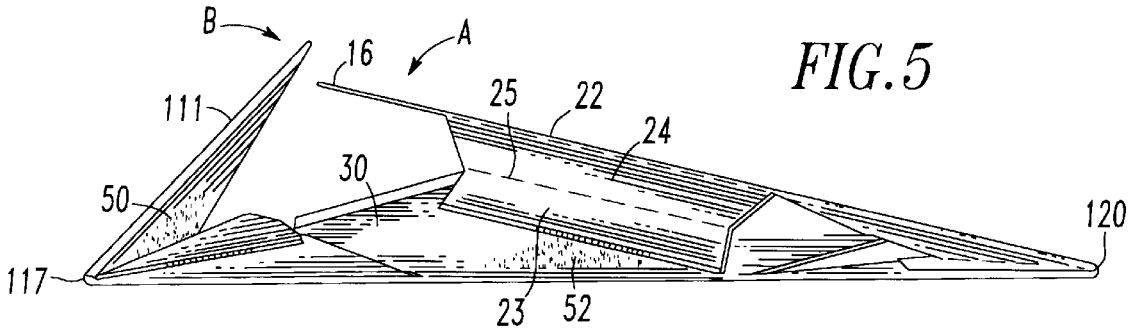
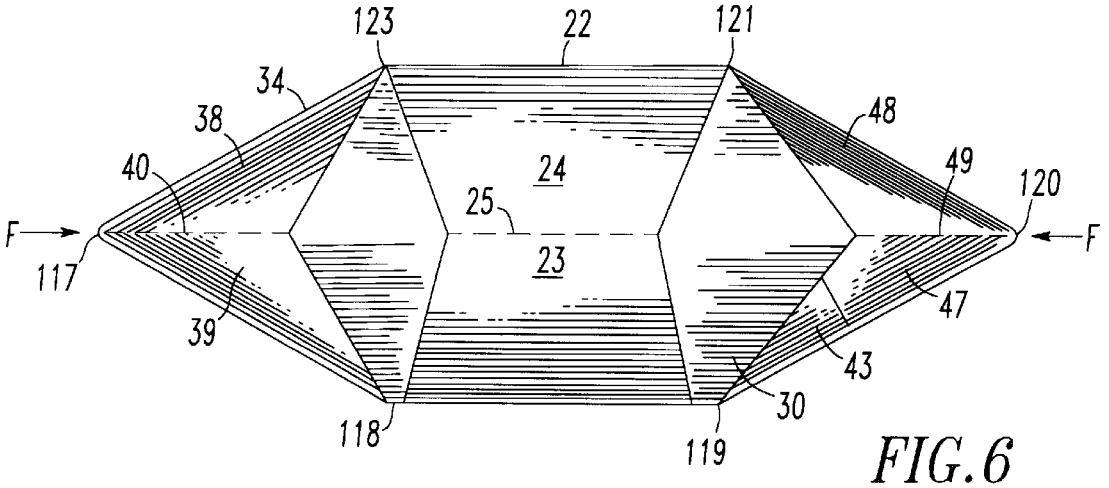
FIG. 6

FIG. 8
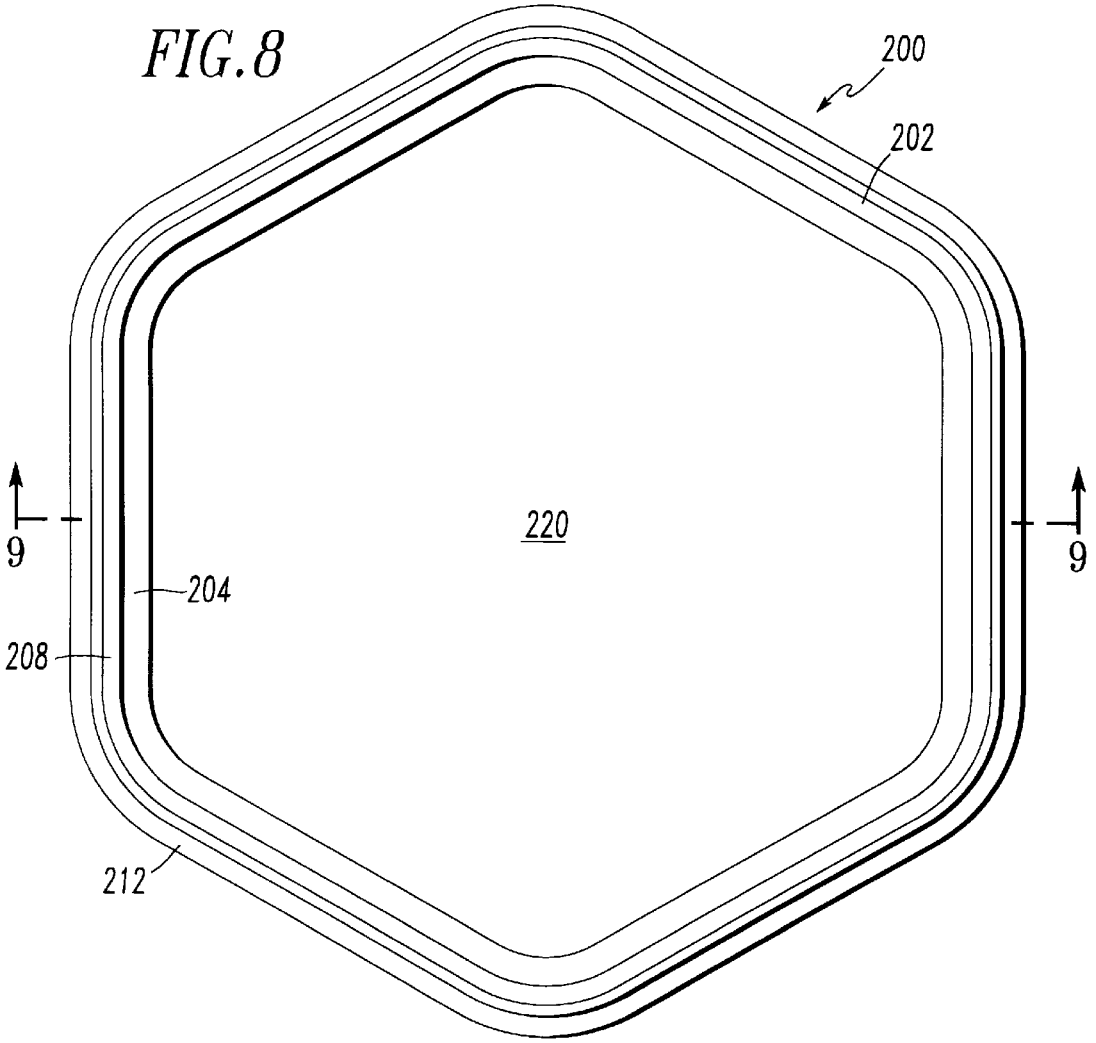
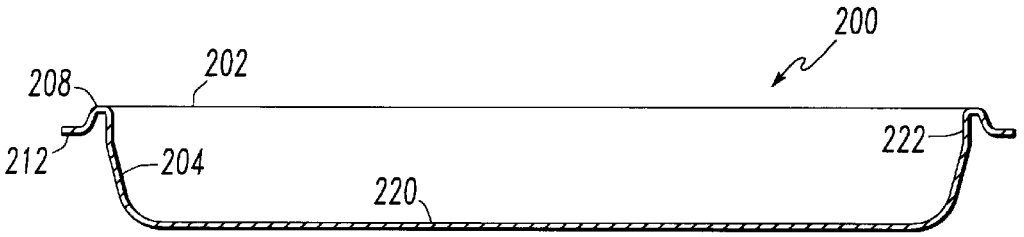
FIG. 9

HEXAGONAL PAPERBOARD CARTON WITH THERMOFORMED REINFORCING LID

This application is a Continuation of Ser. No. 08/523,365, filed Sep. 5, 1995, now abandoned.

TECHNICAL FIELD

The present invention is directed to a carton for containing a plurality of articles including a thermoformed reinforcing lid. More particularly, the present invention is directed to a hexagonal carton having a dual thermoformed reinforcing lid.

BACKGROUND ART

In many instances, it is desirable to package food stuff and the like in a carton or a box like container that can be readily opened, yet are reclosable if the contents thereof are not fully consumed. One instance of such a use is in the fast food service establishments where fried chicken and the like are prepared and taken in carry-out type containers. One well-known type of container is that of a bucket having a separate lid which fits over the top opening of the bucket. While such buckets are readily acceptable by the consumer, in large volume operations, it is desirable that the unused cartons be collapsible for shipment and storage. Yet the cartons must be readily erectable when needed.

In an effort to overcome the aforementioned shortcomings, a hexagonal container for food products and the like is disclosed in U.S. Pat. No. 3,101,167 issued to Styler wherein an automatic bottom hexagonal carton is set forth which when force is applied to the partially formed flattened container, the container expands to form the hexagonal carton. Such a carton also includes an integrally formed lid which covers the top of the carton once the contents are placed therein. While this carton is sufficient for containing food products such as fried chicken and the like, such a container can not readily hold more than one type of item. Moreover, such a container relies on the consumer to open the container in a manner which does not destroy the closure.

Similarly, U.S. Pat. No. 3,809,310 issued to Vanderlogt, Jr. discloses a hexagonal container or food products for the like which includes a flatten carton which when erected automatically forms a bottom closure. Also, such a container includes an integrally formed closure for closing off the opening of the carton after the contents are placed therein. However, as with the container discussed hereinabove, this container is only suitable for containing a single type of product without soiling other products placed therein. Further, like the above noted container, the consumer must open the container in a manner which does not destroy the integrity of the closure or the container.

Clearly, there is a need for an expandable container for food products and the like wherein the container is initially stored in a flat condition and easily erected when needed. Further, there is a need for a carton of the type set forth hereinabove which can readily accommodate not only fried chicken in one portion of the container, but also other items such as rolls, biscuits, utensils, or the like in another part of the container without soiling or exposing the other items to moisture. Moreover, there is a need for a reclosable carton which may be readily opened by the consumer without destroying the integrity of the carton or the closure.

SUMMARY OF THE INVENTION

A primary object of the present invention is to overcome the aforementioned shortcomings associated with the prior art containers.

A further object of the present invention is to provide a container for food stuff which may be readily erected when needed and which includes a reinforcing closure for closing an opening formed in the top of the carton.

Another object of the present invention is to provide a reclosable carton which may be readily opened by the consumer without destroying the integrity of the carton.

Yet another object of the present invention is to provide a readily erectable container including a closure which is telescopically received within an opening in the top of the carton and which frictionally engages an inner surface of the carton.

A still further object of the present invention is to provide an erectable container which when stored is stored in a flat condition such that a large number of cartons may be stacked one upon the other.

Yet another object of the present invention is to provide a carton including a top closure which reinforces the overall structural stability of the carton and which includes a supplemental compartment for containing a second and different type of article than that placed in the carton itself.

A still further object of the present invention is to provide a carton having a reinforcing closure which itself forms a compartment which is subsequently closed by a supplemental closure which frictionally engages a rim of the main closure.

These, all well as additional objects of the present invention, are achieved by providing a collapsible hexagonal carton for containing articles such as prepared food and the like, including a plurality of side panels hingedly connected to one another by substantially parallel fold lines. A bottom panel formed of a plurality of cooperating end panels hingedly connected to respective side panels and a closure for closing a top opening of the hexagonal carton with the closure being telescopically received within the top opening of the hexagonal carton and frictionally engaged with an inside surface of at least one of the side panels. Additionally, the closure may include a supplemental compartment formed therein for containing articles of a type different than that placed in the main body of the carton. In this case, a supplemental closure is provided which cooperates with the first closure for closing off the supplemental compartment.

In a preferred embodiment, the bottom panel is formed of a plurality of cooperating end panels including a main end panel which covers an entire inner surface of the bottom of the carton and which is hingedly connected to one of the side panels, a secondary end panel hingedly connected to a side panel diametrically opposed to the first mentioned side panel and adhered to an outer surface of the main end panel, as well as two pairs of supporting end panels hingedly connected to the remaining side panels with each of the pairs of supporting end panels being adhered to one another and underlie at least a portion of the main end panel when the carton is in an erected condition. Additionally, the main end panel may include at least one reinforcing panel hingedly connected to a free edge of the main end panel such that the reinforcing panel frictionally engages an inside surface of at least one of the side panels when the carton is in the erected position.

These, as well as additional objects and advantages of the present invention will become apparent from the following detailed description when read in light of the several figures.

BRIEF DESCRIPTION OF THE DRAWINGS

FIGS. 4, 5 and 6 are bottom views of the carton being formed from the blank illustrated in FIG. 1.

FIG. 8 is a top view of the primary closure illustrated in FIG. 7.

FIG. 9 is a cross-sectional view of the main closure taken along line IX—IX of FIG. 8.

DETAILED DESCRIPTION OF THE INVENTION

Figure 1:
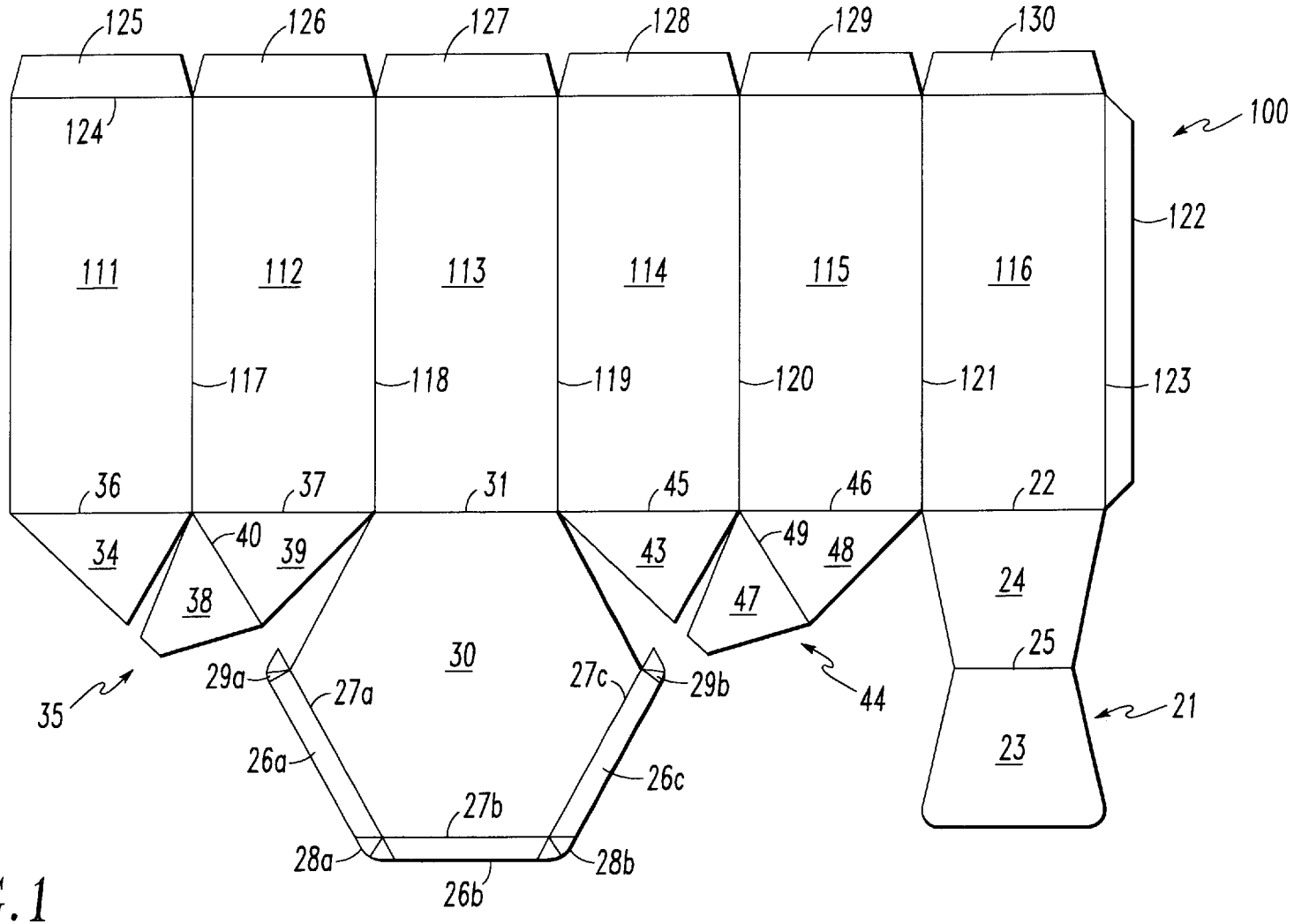
FIG. 1 is a plan view of a paperboard blank for forming the carton in accordance with the present invention.
Figure 2:
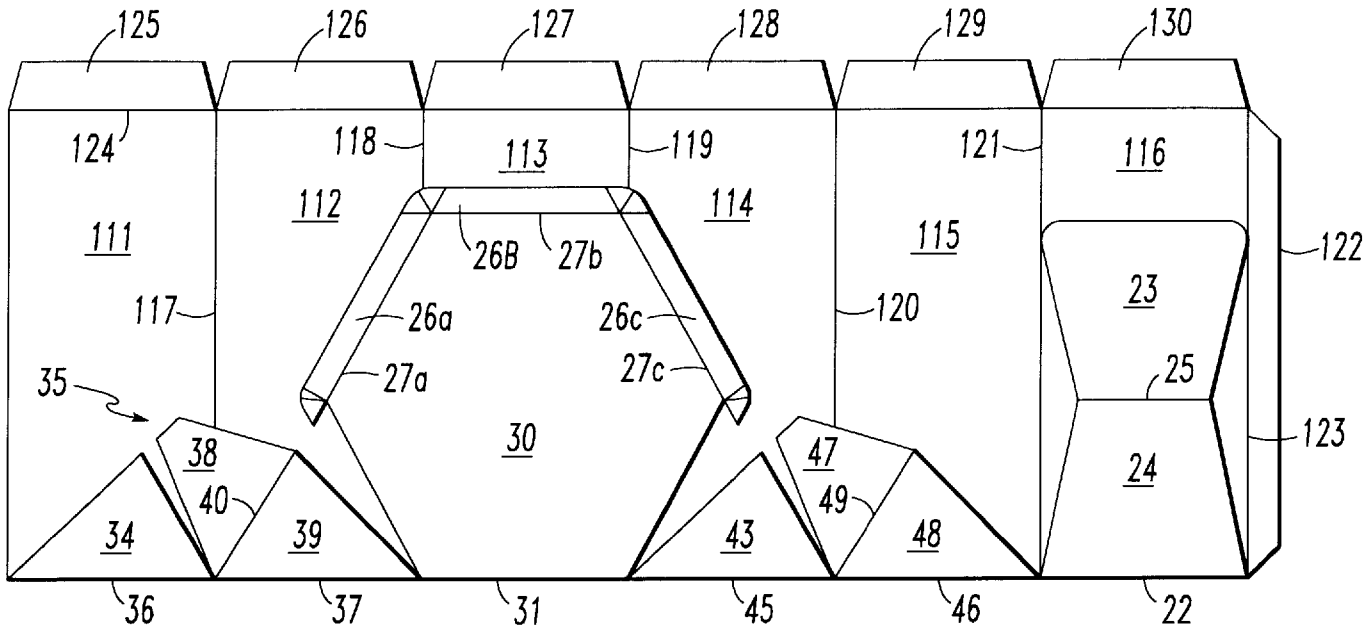
FIG. 2 is a plan view of the paperboard blank in an initial folded position.

In the following description, reference will be made to the accompanying drawings for a better understanding of the invention. In the drawings, all parts are numbered with the same numbers being used to identify the same parts in the several figures.

Referring now to FIG. 1, an integral carton blank 100 cut and scored so as to form a carton in accordance with the present invention includes six side panels 111, 112, 113, 114, 115 and 116 hingedly connected to one another by crease score fold lines 117, 118, 119, 120 and 121, respectively. Additionally, a glue flap 122 is attached to side panel 116 by way of crease score fold line 123. It should be noted that the glue flap 122 may be provided along either side panel 116 as illustrated in FIG. 1 or side panel 111 so long as when erected, the glued flap adheres to the other of the side panels to form a substantially cylindrical carton. Also hingedly connected to each of the respective side panels 111–116 by way of crease score fold line 124 are independent reinforcing flaps 125–130, respectively. The significance of such reinforcing flaps will be described in greater detail hereinbelow.

A series of flaps which cooperate to form the bottom of the finished carton extend from the individual side panels. A first outer bottom panel 21 extends from side panel 116 and is hingedly connected thereto by crease score fold line 22. The outer bottom panel 21 includes two sections, section 23 and section 24 which are hingedly connected to one another along crease score fold line 25. The particular configuration of the two sections is such so as to receive portions of the remaining end panels when the carton is in the erected condition. This will become readily apparent from the discussion hereinbelow.

A main bottom panel 30 is hingedly connected to side panel 113 by way of crease score fold line 31. It should be noted that when in the erected condition, side panels 113 and 116 are diametrically opposed from one another which in turn results in the diametrically opposed positioning of the outer bottom panel 21 and the main bottom panel 30. Additionally, the main panel includes reinforcing flaps 26A, 26B and 26C which are hingedly connected to respective free edges of the main bottom panel 30 by way of fold lines 27A, 27B and 27C. Additionally, web fold sections 28A, 28B, 29A and 29B are provided to interconnect the reinforcing panels 26A, 26B and 26C to add stability to the erected carton. That is, when a carton is erected from the blank illustrated in FIG. 1, the reinforcing panels 26A, 26B and 26C frictionally engage inner surfaces of side panels 111, 115 and 116 which adds significant structural stability to the carton.

In addition to the outer bottom panel 21 and the main bottom panel 30 are a first set for supporting end panels 34 and 35 which are hingedly connected to side panels 111 and 112 by way of crease score fold lines 36 and 37, respectively. Supporting end panel 35 is formed of two sections 38 and 39 which are hingedly connected to one another along crease score fold line 40. Substantially identical to the first set of supporting bottom panels 34 and 35 are supporting end panels 43 and 44 which are hingedly connected to side panels 114 and 115 by way of fold lines 45 and 46, respectively. Additionally, supporting end panel 44 is formed of two articulated sections 47 and 48 which are hingedly connected to one another by way of fold line 49.

The carton formed in accordance with the present invention is erected in the following manner with reference to FIGS. 2–5. It should be understood that while a particular construction of the bottom portion of the hexagonal container is set forth herein, numerous bottom closures may be used without departing from the spirit and scope of the present invention.

Figure 3:
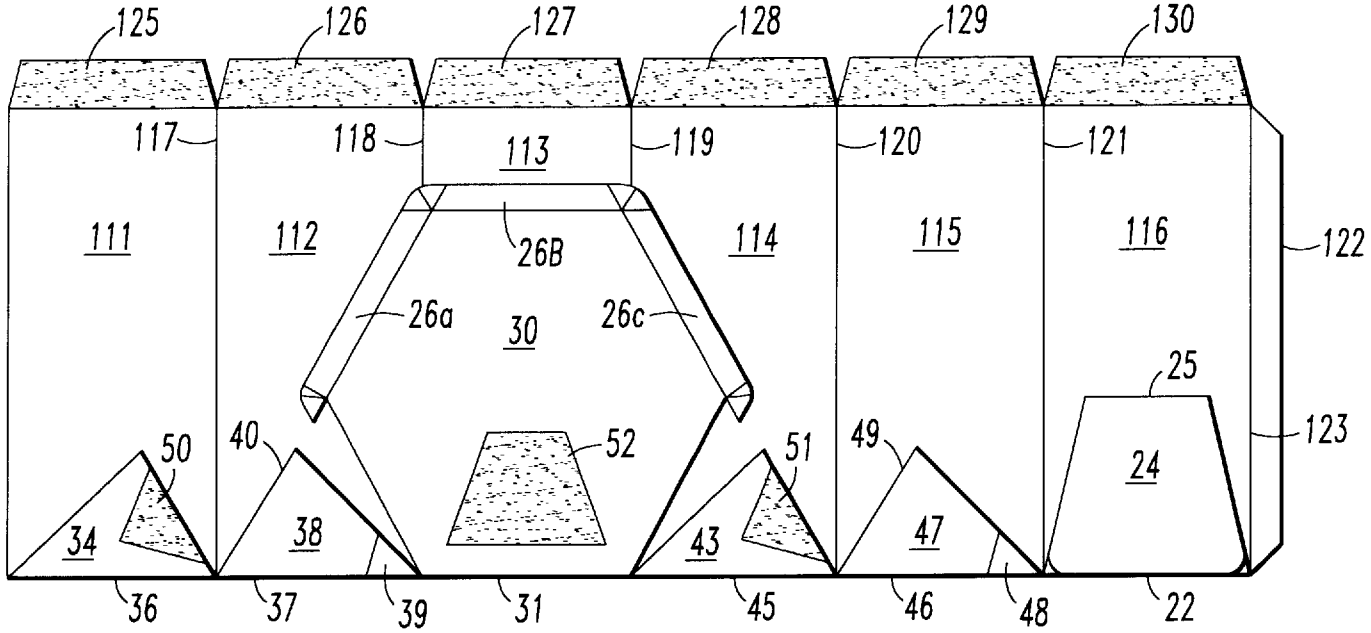
FIG. 3 is a plan view of the blank for forming a carton in accordance with the present invention in a further erected state.

An initial step of the carton assembling operation, and after the blank has been cut and scored by the appropriate devices, the bottom forming panels are all folded along their coextensive crease score fold lines 36, 37, 31, 45, 46 and 22 to lie substantially flat on the several side panels 111–116. In the next step, section 38 of the supporting end panel 35 is folded along fold line 40 and into contact with section 39 of the supporting bottom panel 35 as illustrated in FIG. 3. Similarly, section 47 of the supporting bottom panel 44 is folded along fold line 49 and into contact with section 48 of the supporting bottom panel 44, again as illustrated in FIG. 3. Additionally, section 23 of the outer bottom panel 21 is folded along fold line 25 and over folded onto section 24 into the position as illustrated in FIG. 3. At the same time, glue is applied by any known means to the locations illustrated in FIG. 3. Additionally, glue is applied to an underside of the sealing panel 22 such that the sealing panel 22 adheres to an inside surface of side panel 111.

In this case, a predetermined amount of glue is placed in generally triangular patches at 50 and 51 on supporting bottom panels 34 and 33, respectively. Additionally, a glue patch 52 is provided on the main bottom panel 30 as illustrated in FIG. 3 as well as on either an inner surface of each of the several reinforcing flaps 125–130 or an upper portion of the side walls 111–116.

Referring now to FIGS. 4 and 5, with the panels in the positioned illustrated in FIG. 3, initially the reinforcing flaps are over folded along line 124 into adhering contact with the side panels 111–116. Then, side panels 115 and 116 are over folded along fold lines 120 between side panels 114 and 115 and forced downwardly until it lies flat over side panels 113 and 114. As the over folded panels are pressed down in the direction of arrow A, it will become apparent that panel 47 of the supporting bottom panel 44 will engage the glued patch 51 on supporting bottom panel 43 and be adhered thereto. At the same time, the outer bottom panel 21 which has been folded along fold line 25 contacts and is adhered to a bottom portion of the main bottom panel 30 by virtue of its engagement with the glue patch 52.

Once this folding step has been completed, side panel 111 is folded along crease score fold line 117 in a direction of arrow B and placed into contact with the glue placed on an outer surface of the sealing flap 122. Simultaneous with the adhesion of the panel 111 to the sealing flap 122 is the adhesion of section 38 of the supporting bottom panel 35 to the mating supporting bottom panel 34. In production, side panel 111 is over folded at substantially the same time as the folding of side panels 115 and 116 over side panels 113 and 114. However, it is clear that the over folding of side panel 111 must lag behind the over folding of side panels 115 and 116 such that an inner surface of the side panel 111 is adhered to the sealing flap 122.

Figure 7:
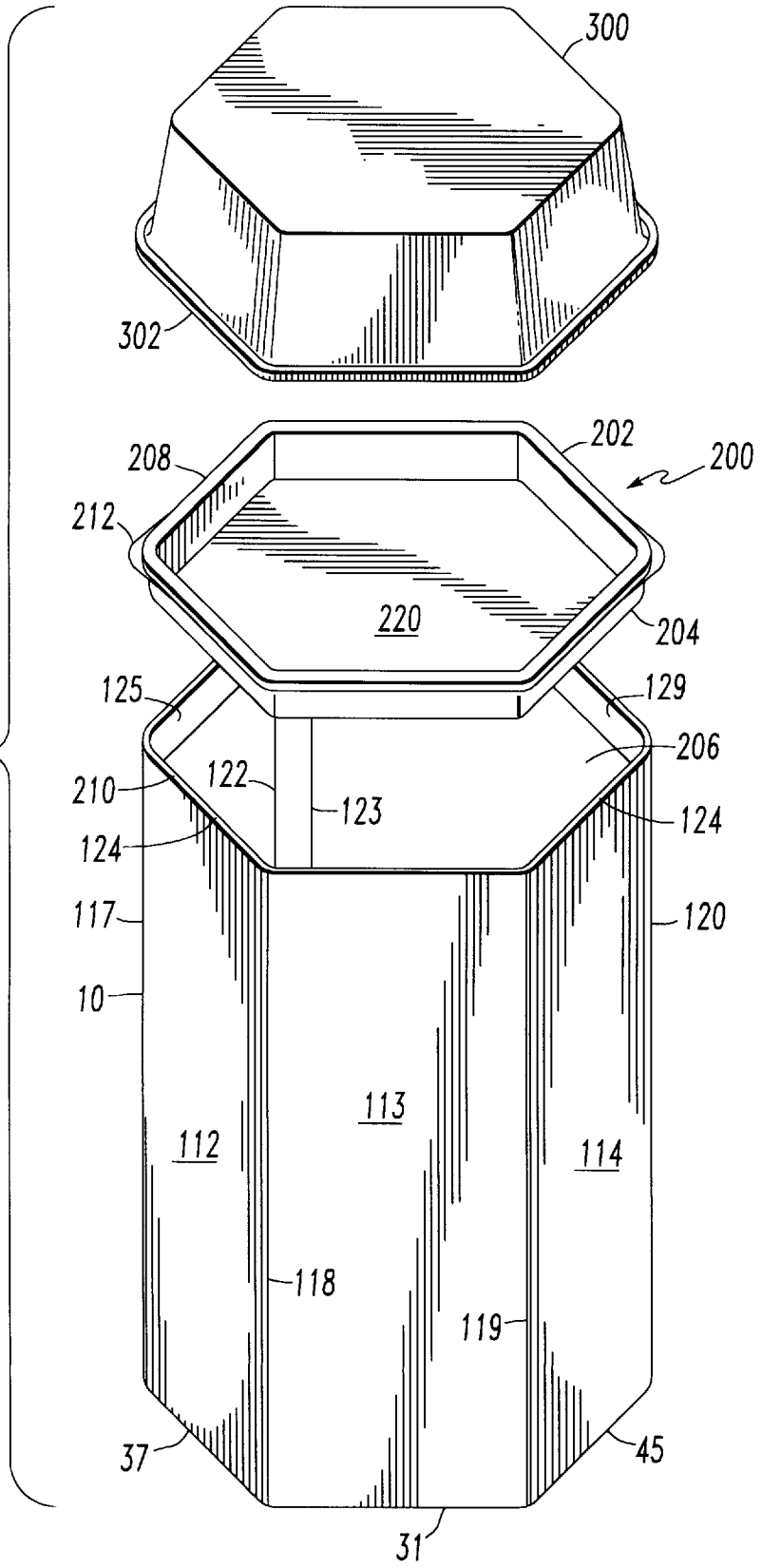
FIG. 7 is a perspective view of the carton in accordance with the present invention in an erected condition including the primary and secondary closures.

Once in this position and adhered in the manner discussed hereinabove, the hexagonal carton can be erected into the position illustrated in FIG. 7 by applying pressure to the edges of the flattened assembled carton, in this case, along crease score fold lines 117 and 120 as illustrated by the arrows F of FIG. 6. The carton will open to the fully opened state as shown in FIG. 7 while the several bottom panels will cooperate with one another to form a multi-ply bottom having complete coverage of the bottom of the carton by way of main bottom panel 30. Additionally, the reinforcing panels 26A, 26B and 26C will contact the inner surface of side walls 112, 113 and 114, respectively by pressing the main panel into its proper position substantially perpendicular to the several side panels. Once in this condition, the hexagonal carton may be readily collapsed by merely pushing upwardly on the central portion of the bottom panel and collapsing the side panels in a manner opposite to that illustrated in FIG. 6.

Referring now to FIG. 7, once in the erected condition as illustrated therein, the hexagonal carton 10 is adapted to receive a first closure 200 in the form of tray 202 having a side wall 204 forming a hexagonal recess having a circumferential dimension substantially equal to that of the main bottom panel 30 of the erected carton 10. The tray can be of any depth so long as the tray is telescopically received within the opening 206 of the carton 10. That is, the side wall 204 of the tray frictionally engages an inner surface of the several side panels in order to maintain the carton 10 in the configuration illustrated in FIG. 7 and to add structural stability to a filled carton. With respect to the carton illustrated in FIG. 10, the side walls 204 of the tray 202 in this case contact a surface of the reinforcing flaps 125–130 which are provided about an upper periphery of the carton 10. While the reinforcing flaps 125–130 aid in the structural stability of the formed carton, the tray 202 maintains the carton in a fully upright and open and condition.

As can be seen from FIG. 7, the tray 200 includes a brim 208 which rests against an upper edge 210 of the carton 10. Additionally, the brim includes a flange 212 which extends outwardly from the tray 204 which aids the consumer in removing the tray 202. In the preferred embodiment, the tray 202 forms an intermediate closure for the carton 10. This intermediate closure being in the form of a tray can be used to contain rolls, biscuits, various side dishes or utensils and the like as desired by the consumer in that the tray 202 forms what can be considered a supplemental compartment for accommodating various goods. Moreover, the tray 202 when removed from the carton 10 can be used as a plate for consuming the contents of the carton 10.

As is further illustrated in FIG. 7, a supplemental closure in the form of a domed lid 300 is provided for covering the contents placed in the tray 202. The domed lid may be of any dimensions so long as the dome lid 300 includes a rim 302 which cooperates with the brim 208 of the tray 202 and frictionally engages such brim so as to maintain the lid 300 in a sealed condition about the tray 202. Similarly, the domed lid 300 may also be used by the consumer when consuming the contents of the carton 10.

Referring now to FIGS. 8 and 9, the tray 202 is illustrated in greater detail. As can be seen from FIG. 8, the tray 202 includes a substantially planar bottom surface 220 which merges into side wall 204 which may be of any desired depth. Similarly, as is illustrated in FIG. 9, the side wall 204 merges into the brim 208 which likewise merges into the flange 212. The tray 202 may be readily molded from any known moldable material by way of any known molding process. In forming the tray 202, it is beneficial that the side wall 204 taper slightly inwardly as illustrated in FIG. 9 so as to aid in the insertion of the tray into the opening of the carton 10. Additionally, it is also important to include a substantially vertical portion 222 of side wall 204 which frictionally engages either an inner surface of the side panels of the carton 10 or the exposed surface of the reinforcing flaps if such flaps are present. Again, when inserted into the carton, the brim 208 rests against an upper edge of the carton 210, thus stabilizing the carton 10 in its erect condition.

Accordingly, by providing a collapsible hexagonal carton for containing articles such as prepared food and the like, including a plurality of side panels hingedly connected to one another by substantially parallel fold lines, a bottom panel formed of a plurality of cooperating end panels hingedly connected to respective side panels and a closure for closing a top opening of the hexagonal carton with the closure being telescopically received within the top opening of the hexagonal carton and frictionally engaged with an inside surface of at least one of the side panels, a carton which can readily accommodate not only fried chicken in one portion of the carton, but also other items such as rolls, biscuits, utensils, or the like in another part of the carton without soiling or exposing the other items to moisture is achieved. That is, the closure may include a supplemental compartment formed therein for containing articles of a type different than that placed in the main body of the carton. In this case, a supplemental closure is provided which cooperates with the first closure for closing off the supplemental compartment.

While the present invention has been described with reference to a preferred embodiment, it should be appreciated by those skilled in the art that the invention may be practiced otherwise than is specifically described herein without departing from the spirit and scope of the invention. It is, therefore, to be understood that the spirit and scope of the invention be limited only by the appended claims.

We claim:

1. A collapsible carton for containing articles comprising:

a plurality of side panels hingedly connected to one another by substantially parallel fold lines;

a bottom panel formed of a plurality of cooperating end panels hingedly connected to respective side panels;

an intermediate closure means frictionally engaging inner surfaces of said plurality of side panels for closing a top opening of the carton; said intermediate closure means including a brim extending outwardly from said side panels and a supplemental compartment formed therein; and a supplemental closure means including a raised central region cooperating with said intermediate closure means for closing said supplemental compartment.

2. The carton as defined in claim 1, wherein said supplemental closure frictionally engages said brim of said intermediate closure.

3. The carton as defined in claim 1, further comprising a reinforcing rim about an upper periphery of the carton, said reinforcing rim including a plurality of side panel extensions hingedly connected to said side panels, each of said side panel extensions being over folded and adhered to an inside surface of said respective side panel.

4. The carton as defined in claim 3, wherein said intermediate closure means frictionally engages said reinforcing rim.

5. The carton as defined in claim 4, wherein said intermediate closure includes a brim having a flange extending from said reinforcing rim of the carton.

6. The carton as defined in claim 5, wherein said supplemental closure frictionally engages said brim of said intermediate closure.

7. The carton as defined in claim 1, wherein said plurality of cooperating end panels forming said bottom panel include a main end panel which covers an entirety of a bottom of the carton, and is hingedly connected to one of said side panels, a secondary end panel hingedly connected to the side panel diametrically opposed to said one of said side panels and adhered to said main end panel and two pairs of supporting end panels hingedly connected to the remaining side panels, each of said pairs of supporting end panels being adhered to one another and underlying at least a portion of said main end panel when the carton is in an erected position.

8. The carton as defined in claim 7, wherein said main end panel includes at least one reinforcing panel hingedly connected to an edge of said main end panel such that said reinforcing panel frictionally engages an inside surface of at least one of said side panels when the carton is in an erected position.

9. The carton as defined in claim 8, wherein said reinforcing panel of said main end panel includes three reinforcing panel sections with adjacent reinforcing panel sections being interconnected with one another by a web fold section.

10. A carton for containing articles comprising:

a plurality of side panels hingedly connected to one another by substantially parallel fold lines;

a bottom panel formed of a plurality of cooperating end hingedly connected to respective side panels;

a reinforcing rim about an upper periphery of the carton, said reinforcing rim including a plurality of side panel extensions each hingedly connected to a respective side panel, each of said side panel extensions being over folded and adhered to an inside surface of said respective side panel;

a closure means for closing a top opening of said carton, said closure means being telescopically received within said top opening of said carton and frictionally engaged with said reinforcing rim for closing and supporting an upper extent of the carton, said closure means including a brim having a flange extending from said reinforcing rim and a supplemental compartment; and a supplemental closure means cooperating with said closure means for closing said supplemental compartment.

11. The carton as defined in claim 10, wherein said supplemental closure frictionally engages said brim of said closure.

12. The carton as defined in claim 10, wherein said plurality of cooperating end panels forming said bottom panel include a main end panel which covers an entirety of a bottom of the carton, and is hingedly connected to one of said side panels, a secondary end panel hingedly connected to the side panel diametrically opposed to said one of said side panels and adhered to said main end panel and two pairs of supporting end panels hingedly connected to the remaining side panels, each of said pairs of supporting end panels being adhered to one another and underlying at least a portion of said main end panel when the carton is in an erected position.

13. The carton as defined in claim 12, wherein said main end panel includes at least one reinforcing panel hingedly connected to an edge of said main end panel such that said reinforcing panel frictionally engages an inside surface of at least one of said side panels when the carton is in the erected position.

14. The carton as defined in claim 13, wherein said reinforcing panel of said main end panel includes three reinforcing panel sections with adjacent reinforcing panel sections being interconnected with one another by a web fold section.

15. The carton as defined in claim 10, wherein said supplemental closure includes a raised central region.

* * * * *